United States Patent [19]

Yamashita et al.

[11] 4,198,585

[45] Apr. 15, 1980

[54] GAS DISCHARGE PANEL

[75] Inventors: Hideo Yamashita, Akashi; Shizuo Andoh, Kobe; Tsutae Shinoda, Akashi, all of Japan

[73] Assignee: Fujitsu Limited, Japan

[21] Appl. No.: 742,993

[22] Filed: Nov. 18, 1976

[30] Foreign Application Priority Data

Nov. 19, 1975 [JP] Japan ..... 50/139481

[51] Int. Cl.[2] ..... H01J 61/30

[52] U.S. Cl. ..... 313/218; 313/221; 427/107; 427/109; 427/126; 427/255; 427/255.2

[58] Field of Search ..... 313/218, 221; 427/107, 427/109, 126, 248 B, 255

[56] References Cited

U.S. PATENT DOCUMENTS

| | | | |
|---|---|---|---|
| 3,827,776 | 8/1974 | Nakayama et al. | 313/188 X |
| 3,836,393 | 9/1974 | Ernsthausen et al. | 313/221 X |
| 3,846,171 | 11/1974 | Byrum et al. | 117/223 |
| 3,904,906 | 9/1975 | Osawa et al. | 313/188 |
| 3,976,823 | 8/1976 | Ernsthausen | 313/221 X |
| 3,989,982 | 11/1976 | Schaufele | 315/169 TU |
| 4,114,064 | 9/1978 | Ernsthausen | 313/221 X |
| 4,126,807 | 11/1978 | Wedding et al. | 313/221 X |
| 4,126,809 | 11/1978 | Wedding et al. | 313/221 |

*Primary Examiner*—Rudolph V. Rolinec
*Assistant Examiner*—Darwin R. Hostetter
*Attorney, Agent, or Firm*—Staas & Halsey

[57] ABSTRACT

The gas discharge panel described here is an AC plasma display panel with electrodes arranged on a substrate, and the electrodes and substrate are coated with a dielectric layer for insulation from the gas filled discharge space, with an improvement in the dielectric layer surface. The improvement being an overcoat layer of at least two alkaline earth compounds, especially CaO and SrO, provided on the dielectric layer surface of this display panel. This overcoat layer significantly lowers the operating voltages of the panel.

27 Claims, 5 Drawing Figures

GAS DISCHARGE PANEL

BACKGROUND OF THE INVENTION

1. Field of the Invention

This invention relates to a gas discharge panel, and to an improvement in an AC plasma display panel having a plurality of parallel electrode sets arranged transversely to each other on each of a pair of opposing substrates, which are coated with a dielectric layer to provide insulation of the electrodes from the gas filled discharge space.

2. Description of the Prior Art

Typically, in an AC plasma display panel, a plurality of electrodes are arranged on two substrates face to face across a discharge space, which is filled with gas such as neon (Ne) and display is achieved by causing selective discharge between chosen electrodes. In a gas discharge panel of this type, the structure and material of a dielectric layer on the electrodes greatly influences the operating voltages and service life. Therefore, various methods for improving dielectric layers have been proposed.

As described in the U.S. Pat. No. 3,716,742 to Nakayama et al, an overcoat layer composed of a heat resistant oxide is disclosed as being on the dielectric layer which insulates the electrodes. The overcoat disclosed in the Nakayama et al. patent may be directly or indirectly formed on the dielectric layer, which generally consists of low melting point glass containing PbO. The overcoat is seen as a protection layer for preventing sputtering damage from ion bombardment or as a secondary electron emissivity layer for lowering the operating voltage.

Materials that have been proposed for the overcoat layers are various metal oxides, oxides of rare earth elements such as $CeO_2$ and $La_2O_3$, or oxides of group IIA elements, known also as the alkaline earth metals.

U.S. Pat. No. 3,863,089, to Ernsthausen, shows that MgO (magnesium oxide) is in many ways a satisfactory material, since it has an excellent ion bombardment resistivity at the comparatively low operating voltages resulting from its comparatively high secondary electron emissivity. However, a panel with an MgO overcoat on the dielectric layer still requires sustaining voltages of 90 to 120 V and writing voltages of 100 V or more. However, these operating voltages are generally too high to be driven by integrated circuits. It is therefore desirable to reduce the operating voltages as low as possible in order to allow use of driving components which generate lower voltages and are lower in cost. It is also desirable to achieve a more stable operation by increasing the operating life of the panel.

SUMMARY OF THE INVENTION

An object of the present invention is to provide an AC plasma display panel having reduced firing and sustaining voltages with an improved dielectric layer.

A further object of the present invention is to provide a method of manufacturing an AC plasma display panel with an overcoat layer on the dielectric layer in order to lower the operating voltages.

This invention relates to a gas discharge panel with sets of electrodes arranged on opposing substrates and coated with a dielectric layer for insulation from the gas discharge. The invention is characterized in that at least the surface area of said dielectric layer opposite and corresponding to the area of the electrodes is coated with a material containing a mixture of two or more alkaline earth metal compounds. According to the present invention, an overcoat layer composed of a mixture of strontium oxide (SrO), an alkaline earth metal compound, and of at least one other alkaline earth metal oxide is provided on the dielectric layer. The method for applying the overcoat layer utilizes oxygen-containing compounds of alkaline earth metals, except for the oxides thereof, as the starting material. An evaporation process results in an oxide coating being formed on the dielectric layer.

According to another characteristic of this invention, at least the surface of the dielectric layer is formed from a material composed of a mixture of at least two kinds of alkaline earth metal compounds and one or more kinds of reducing elements.

An AC plasma display panel utilizing the present invention exhibits stable operating characteristics over a long period of time with a firing voltage of 80 V or less and a sustaining voltage of 70 V or less. The present invention demonstrates the distinct effect of lowered operating voltages, as compared with prior art panels. A preferred embodiment of this invention is described in detail herebelow, with reference to the attached drawings.

DETAILED DESCRIPTION OF THE INVENTION

Figure 1:
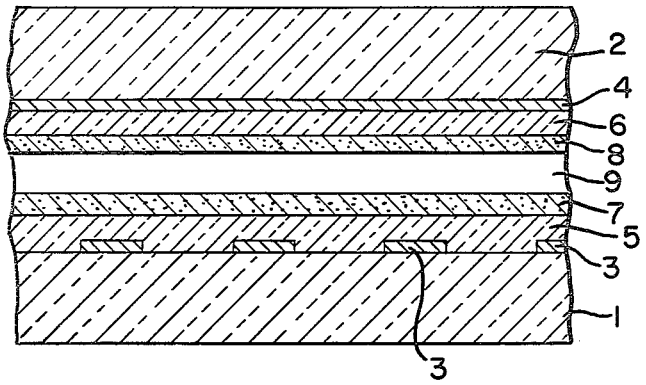
FIG. 1 is an enlarged sectional view of the main part of a gas discharge panel illustrating an embodiment of the present invention.

With reference to FIG. 1, the gas discharge panel is illustrated as a flat-shaped hermetically sealed envelope consisting of a pair of substrates 1 and 2, at least one being soda lime glass or some other suitable transparent material. A plurality of row electrodes 3, column electrodes 4 are arranged transversally to each other on respective substrates 1 and 2. The dielectric layers 5 and 6 are shown covering respective electrodes 3 and 4. The dielectric layers 5 and 6 are formed of low melting temperature glass having a large fraction of lead oxide (PbO) and serve to insulate the opposing electrodes from each other.

As mentioned previously, this invention is characterized in that the gas contacting surface area of the dielectric layer is formed of a new material as described below in detail.

In FIG. 1, example overcoat in layers 7 and 8 are shown on respective dielectric layers 5 and 6. The dielectric layers 5, 6 and the overcoat layers 7, 8 on these dielectric layers can together be referred to as a composite dielectric layer from the point of view of their function in a display memory utilizing wall charges in this gas type discharge panel. A discharge gas mixture, such as neon and xenon, occupies the space 9 between the overcoat layers 7 and 8.

Figure 2:
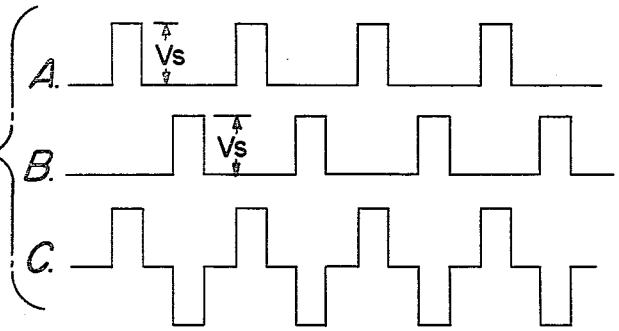
FIG. 2 shows the driving voltage waveforms applied to the gas discharge panel, as shown in FIG. 1.

Square pulse voltages $V_s$ (sustain voltage) shown in FIG. 2(A) and (B) are applied to opposed electrodes 3 and 4 according to usual operating methods and thereby the AC voltage as shown in FIG. 2(C) appears across the discharge gap at the point determined by the intersections of the electrodes 3 and 4. The sustain voltage value Vs of this AC voltage pulse on each electrode is insufficient by itself to cause discharge, but the amplitude is selected sufficient to cause discharge at the intersecting point with the help of the wall charges. Once a discharge is initiated by a combination of a writing pulse voltage Vw exceeding the initial breakdown or firing voltage Vf across a given gap defined by two or more opposing electrodes, then discharge continues periodically at the corresponding discharge point when the lower sustaining voltage Vs is applied to the electrodes. This occurs because of the wall charge storage function. The abovementioned sustaining voltage Vs and the firing voltage Vf are collectively referred to as the operating voltages.

As mentioned above, the overcoat layers 7 and 8 (or dielectric layers 5 and 6) are formed as mixtures consisting of two or more compounds of alkaline earth metals, particularly: the oxides of BaO, CaO, SrO, and MgO; fluorides such as $CaF_2$, $BaF_2$, $SrF_2$, and $MgF_2$, borides such as $BaB_6$, and $SrB_6$; and carbonates such as $CaCO_3$, $BaCO_3$ and $SrCO_3$. The mixture of the alkaline earth metal oxides has a work function of 1.0 to 1.4 eV, while pure MgO and $La_2O_3$, etc., used as protection layers in conventional gas discharge panels has a work function of 2.0 to 4.0 eV. Therefore, in the present invention, a comparatively large number of electrons are emitted and the material is locally heated by discharge between electrodes. Therefore, firing and sustaining voltages are relatively lower. Since the firing voltage in the gas discharge panel is very dependent on the secondary electron emissivity coefficient of the surface of the dielectric layer in contact with the gas, the operating voltage can be reduced by utilizing a material having a lower work function.

For example, a mixture of BaO and SrO (in 1:1 ratio); or a mixture BaO+SrO+CaO (5:5:1) is well known for its large thermal electron emission coefficient and is used as cathode material in electron tubes. In the aforesaid mixtures, during operation at a high temperature, Ba is separated and migrates to the surface, forming a monatomic layer of Ba, which is a source of emitted electrons.

As employed in the present invention in conjunction with a gas discharge panel, a layer of the abovementioned mixture in contact with the discharge gas space, a high temperature area is locally generated by the discharge between electrodes. A monatomic layer of alkaline earth metal is subsequently formed at the surface, due to the heat, and the emission of secondary electrons due to the shock of incident ions, electrons and photons increases. Thus, the gas discharge panel of the present invention is operated at a lower operating voltage to prevent overheating of the surface.

If the mixture of alkaline earth metal compounds mentioned above is sufficiently resistant to sputtering damage from ion bombardment, the dielectric layer itself can be formed of such a mixture and the separate overcoat layer can be omitted. On the other hand, if the dielectric layers 5, 6 consist of glass having a low melting point it is sufficient to coat over the dielectric layer surface a layer of the mixture, as shown in FIG. 1. In any event, it is required that at least the surface of the dielectric layer in contact with the gas at the discharge points must be formed by a mixture consisting of two or more compounds of alkaline earth metal. The entire dielectric layer surface can be covered, as mentioned above, but at least that part of the surface corresponding to the electrode intersection areas or discharge points must be covered.

As another embodiment of the present invention, at least one of several kinds of reducing elements such as Al, Si, W, Ti, Cu, Fe, Mn, C, etc., alkaline earth metals, or alloys such as Mg—Ni may be mixed with said alkaline earth metal compounds in amounts of 10% or less. The reduction competes for the oxygen of the oxides, and separation of the alkaline earth metal such as Ba or Sr is promoted. A monatomic layer with low work function results at the surface exposed to the discharge, thereby causing a distinct lowering of operating voltages. It is also possible to increase the emission of electrons through the formation of dot-shaped semiconductor island-like areas on the surfaces by injecting metal atoms into the discharge points of the oxide layer surface.

Since the oxides of Ba and Sr exhibit considerable humidity absorption and are comparatively susceptible to damage from ion bombardment, processing is facilitated by previously preparing a micro-incapsulated coating with sputtering resistant materials such as $SiO_2$ and $Al_2O_3$ and to form the dielectric layers 5, 6 or overcoat layers 7, 8 by mixing the capsula. Similarly, whether or not the overcoat layers 7, 8 are formed, at least the surface areas of the dielectric layers 5, 6 may be formed with a high porosity and the abovementioned alkaline earth metal compounds having high electron emissivity, especially the oxides or mixtures thereof, can be impregnated therein with a reducing element as desired.

As another embodiment, a protection layer having ion-bombardment or sputtering resistivity, such as MgO, $CeO_2$ or $La_2O_3$ can be formed on a dielectric layer consisting of several alkaline earth metal oxides, or on an overcoat consisting of such material formed on an ordinary dielectric layer. For example, when dielectric layers 5, 6 or overcoat layers 7, 8 are formed of the above mixture of BaO+SrO+CaO and the protection layer of $CeO_2$ is further formed thereon, the Ba atom is separated by the local heating from the discharge and a monatomic layer of Ba is then formed on the surface of the $CeO_2$ protection layer due to migration of the Ba atoms. As a result, electron emissivity of the protection layer is improved, thus resulting in long service life and significantly lower operating voltages. In this case, a porous protection layer may be formed in order to promote Ba migration. In addition, we have found that a long operating life combined with an increased stability in operating voltages results from using a compound of one or more rare earth elements in the mixed material of two or more alkaline earth metal compounds.

The overcoat layers 7, 8, which are also electron emission layers can be formed not only directly on the dielectric layers 5, 6 but also on an intermediate layer of insulating material such as $Al_2O_3$ provided between these dielectric layers. The intermediate layer in this case is useful for eliminating the influence of contamination from the dielectric layer surface and for obtaining uniformity in the overcoat layer thickness. In addition, this intermediate layer is useful for preventing possible micro-cracking in the overcoat layer due to heating processes employed in panel sealing after the coating is formed.

Figure 3A:
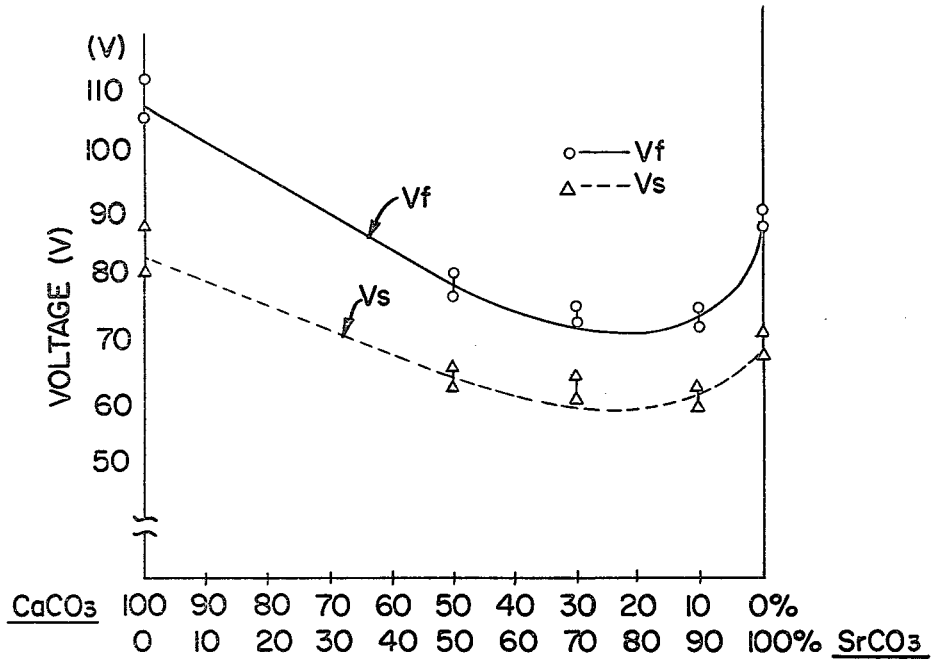
FIGS. 3(A) and 3(B) show the plotted relations between mixing ratios of two alkaline earth metal compounds in the source material which is evaporated to form the overcoat or protection layer on the dielectric layer, as a function of operating voltage.

Empirical results of the present invention are now discussed. FIG. 3 is a plot of variation in firing and sustaining voltages after 1000 hours of operating time due to various different ratios of the materials in the mixture of ratios of $SrCO_3$ and $CaCO_3$ in the evaporation source material, resulting in a 3000 Å overcoat layer of mixed SrO and CaO on the dielectric layer of low melting temperature glass. The weight ratio in percentage is shown on the X axis and voltage on the Y axis, with the firing voltage Vf shown by the solid line and the sustaining voltage Vs shown by the dashed line. The gas discharge panel used in obtaining the measurements shown in FIG. 3 had the configuration shown in FIG. 1. The average thickness of dielectric layer including the overcoat layer was 21μ, the gas discharge space 9 was 120μ, filled with a gas mixture of Ne with 0.3% Xe at 400 Torr total pressure. The overcoat layers were formed from the alkaline earth metal compounds $CaCO_3$ (calcium carbonate) and $SrCO_3$ (strontium carbonate), defined as the evaporant source material. These materials were first sintered and then ground. They were then mixed and pressed at a predetermined weight ratio and then electron beam evaporated to a thickness of 3000 Å over the dielectric layers 5, 6, of glass material having a low melting temperature (the steps of mixing and pressing are, in this case, equivalent to pressing individual sintered source materials). During evaporation the $CaCO_3$ and $SrCO_3$ change to the oxide mixture (Ca+Sr)O by separation of $CO_2$.

As shown in FIG. 3 (A), when the overcoat layer of (Ca+Sr)O is formed on the dielectric layer surface from an evaporant source material of a mixture of two kinds of alkaline earth metal compounds, $CaCO_3$ and $SrCO_3$, the firing voltage $V_f$ and sustaining voltage $V_s$ are considerably lower than when either is used alone as the source material. This lowering of the operating voltage is particularly effective for a certain range of mixing ratios, $CaCO_3$ 50 to 10%, with $SrCO_3$ corresponding 50 to 90% of the evaporant source material.

Figure 4:
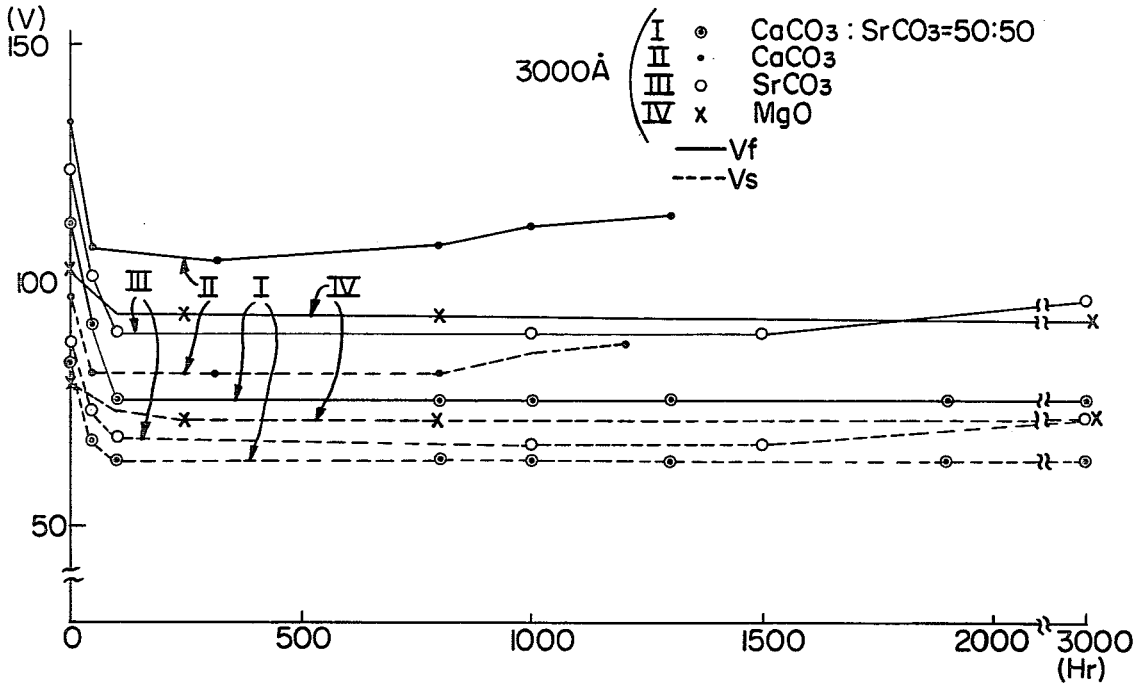
FIG. 4 shows the change in operating voltages with respect to operating time.

FIG. 4 shows the results of life testing, where the variation in firing and sustaining voltages with respect to operating time are shown for four kinds of source materials for coatings by solid and dashed lines respectively.

Curve I shows the characteristics for the panel using a 50:50 mixture of $CaCO_3$ and $SrCO_3$ in the evaporant material. The resulting mixed composition layer operates stably at a firing voltage of 77 V and a sustaining voltage of 64 V after aging 100 hours. On the other hand, curve II for $CaCO_3$ and curve III for $SrCO_3$ respectively show undesirable results, that is, the operating voltages, which gradually increase after 800 to 1200 hours.

The panel with a layer of MgO shows comparatively stable characteristics in FIG. 4, but its operating voltage is relatively high. Thus, FIG. 4 shows that a gas discharge panel with layers formed using $CaCO_3$ and $SrCO_3$ as source material for electron beam evaporation can stably operate for a long period of time, with lower operating voltages. Moreover, from the stability shown for MgO layers and the low voltage characteristics shown by layers formed from evaporation of $SrCO_3$ the inventors have found that satisfactory characteristics can also be obtained by using a mixture of $SrCO_3$ and MgO.

The inventors have found that lowered panel operating voltages also are exhibited in gas discharge panels with overcoat layers 7, 8 of (Sr+Mg)O formed on dielectric layers 5, 6 using the mixture of $SrCO_3$ and MgO as the source material to the same extent as observed in panels with overcoat layers formed by evaporation of $SrCO_3$ and $CaCO_3$, as mentioned above.

FIG. 3 (B) shows the relation between the mixing ratios, of $SrCO_3$ and MgO expressed as weight percentages in the source material for the overcoat layer, with respect to operating voltages after 1000 hours. The plotted curves $V_f$ and $V_s$, respectively show variations in the firing and sustaining voltages. FIG. 3 (B) shows that lower sustaining voltages of about 60 V and firing voltages of 80 V or less can be obtained when $SrCO_3$ from 50 to 70% is mixed with MgO of 50 to 30% in the evaporant source material. In this case, the operating specifications of the panel are almost the same as that described above.

Desirable results from material selection depends largely on manufacturing techniques and processes. In contrast, when such material is used on cathodes of electron tubes, an activation processing is performed after assembly at a high temperature of about 1000° C. or more, and as a result, excellent thermal electron emissivity is obtained. However, such high temperature processing of gas discharge panels is impossible after assembly, since there are low melting temperature glass parts, namely, the dielectric layers 5, 6 and the sealed part (not illustrated) for connecting the substrates. Prior to assembly, it would also be impossible to apply high temperature, since the alkaline earth metal oxides such as BaO and SrO etc., show high humidity absorption and are likely to change to more stable hydroxides when exposed to air. When the overcoat layer material comprises such an oxide, the oxide changes to the hydroxide during exposure to the atmosphere in processing following evaporation, and any high temperature cycling for the activation after fabrication would be impossible since $H_2O$ etc. would be released during operation with undesirable results. In order to avoid such moisture absorption in the present invention, a compound containing oxygen, but which is not the humidity absorbing oxide of an alkaline earth metal, is used as the source material. For example, a carbonate or hydroxide, which are both comparatively stable in air, is used as the source material. Carbonates or hydroxides of alkaline earth metals are mixed with oxides, carbonates, or hydroxides of other alkaline earth metals at a predetermined ratio and pressed into a form. Then the formed material is sintered at a temperature of 700° to 1500° C., by which $CO_2$ or $H_2O$ is released from the carbonate or hydroxide. Coating this material on the dielectric layer by electron beam vacuum evaporation produces an overcoat of this oxide in solid solution or mixed within non-crystalline material, and any potential for deterioration of operating voltages is avoided.

A more detailed description of the process of forming the overcoat layer of the present invention follows.

First, $SrCO_3$ and $CaCO_3$ are mixed in a weight ratio of 7:3 and pulverized for about 30 hours. Then the mixed powder is pressed into a form having a predetermined size, put into a quartz crucible and sintered by heating for a period of about 3 hours or longer at a temperature of about 1000° C. under vacuum or in an inactive (inert) ambient gas. The substrate and electrodes thereon are covered with a dielectric layer of low melting temperature glass, and an intermediate layer of $Al_2O_3$ is evaporated thereon by an electron beam to a thickness of about 3000 Å. Similarly, the mixed and sintered material, prepared as above is then evaporated on the intermediate layer to about 3000 Å. The panels manufactured by the above stated process operate stably for periods of 4000 hours or longer with firing voltages of about 70 V and sustaining voltages of about 60 V (almost the same characteristics as for the case reflected in FIG. 3A).

Figure 3B:
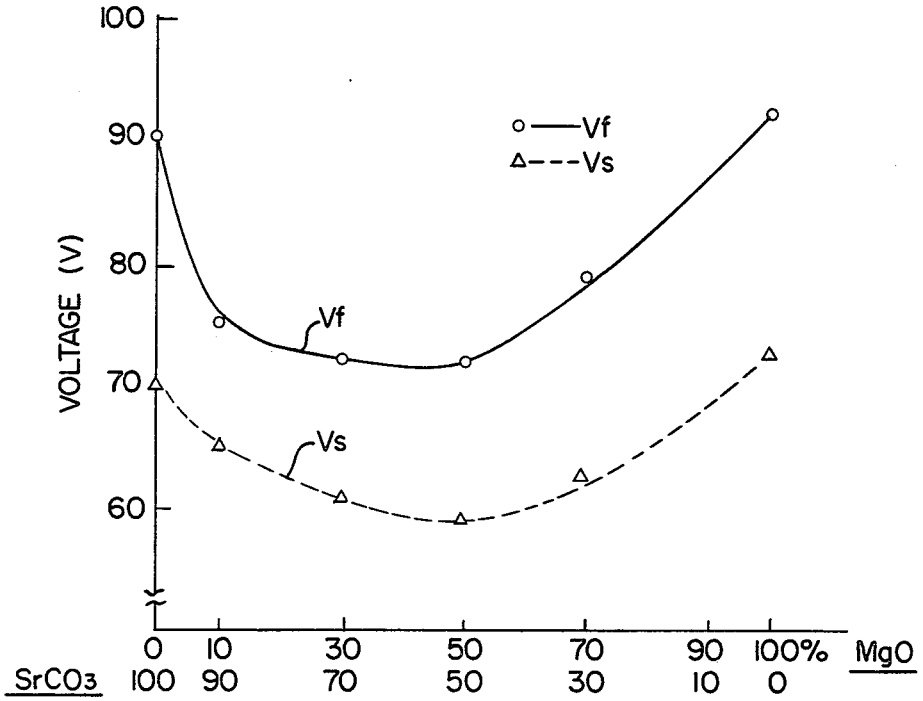

Panels manufactured by a similar process using $SrCO_3$ and MgO showed good results similar to those of FIG. 3B.

In order to manufacture panels having the desired lower operating voltages, it is recommended that the evaporant source material employed to form the overcoat layer on the dielectric layer be a compound which is stable in air and will form a solid oxide by vaporization. Techniques suggested for such evaporation process are those such as sputtering evaporation, flash evaporation, resistance heating evaporation, and electron beam evaporation.

When the evaporation is done in a vacuum, it is necessary to pre-heat the source material to a temperature of about 500° C. to release any gas trapped in the material and avoid any adverse influence during the evaporation process. This pre-heating is not required where a resistance heating evaporation technique is employed.

The overcoat layer may, also be formed using two or more materials as individual evaporation sources, instead of preparing the mixed material for evaporation.

The lower operating voltages and increasing panel life are significant improvements in the prior art. These effects may also be realized by coating the dielectric layer surface with a material containing at least two alkaline earth metal compounds. This invention is not limited to the embodiments described above; other modifications of the invention can easily be realized by persons skilled in the field of display panels by combination of this invention with prior art, including for example, by selectively coating areas corresponding to defined discharge points for controlling those discharge areas.

I claim:

1. In a gas display panel having discharge points defined by opposing sets of electrodes on opposing substrates across a gas filled volume, with each of said electrodes coated with a respective dielectric layer, the improvement comprising:

an overcoat layer between each of said electrodes and said gas at least at said defined discharge points, said overcoat layer being a material comprising a mixture of at least two alkaline earth metal compounds, the alkaline earth metal in one of said at least two alkaline earth metal compounds being strontium.

2. A gas discharge panel as in claim 1, wherein said strontium compound is strontium oxide.

3. In a gas discharge display panel having discharge points defined by opposing sets of electrodes on opposing substrates across a gas filled volume, with each of said electrodes coated with a respective dielectric layer, the improvement comprising:

an overcoat layer between each of said electrodes and said gas at least at said defined descharge points, said overcoat layer being a material comprising a mixture of at least two alkaline earth metal compounds, said overcoat layer being formed by evaporating a source material mixture of a strontium compound in a range of from 50 to 70 wt% and a magnesium oxide in a range of from 50 to 30 wt%.

4. A gas discharge panel as in claim 3, wherein said alkaline earth metal compounds are strontium oxide and magnesium oxide.

5. A gas discharge panel as in claim 3, wherein said strontium compound is strontium carbonate.

6. In a gas discharge display panel having discharge points defined by opposing sets of electrodes on opposing substrates across a gas filled volume, with each of said electrodes coated with a respective dielectric layer, the improvement comprising:

an overcoat layer between each of said electrodes and said gas at least at said defined discharge points, said respective dielectric layer separating said electrode from said overcoat layer, said overcoat layer being a material comprising a mixture of at least two alkaline earth metal compounds; and an insulating layer comprising a material selected from the group consisting of $S_iO_2$ and $Al_2O_3$ intermediate said dielectric layer and said overcoat layer.

7. In a method of manufacturing a gas discharge display panel, wherein opposing sets of electrodes are arranged on opposing substrates across the gas filled volume and coated with a dielectric layer, the improvement comprising:

preparing a source material mixture of at least two alkaline earth metal compounds in determined amounts, evaporating said source material mixture onto said dielectric layer to form an overcoat layer in contact with said gas, said overcoat layer comprising a mixture of oxides of said alkaline earth metals.

8. A method as in claim 7, wherein said source material mixture comprises a strontium compound and a calcium compound.

9. A method as in claim 8, wherein said strontium compound is strontium carbonate and said calcium compound is calcium carbonate.

10. A method as in claim 7, wherein said alkaline earth compounds are strontium carbonate and magnesium oxide.

11. A method as in claim 10, wherein said predetermined amount of strontium carbonate is in a range of from 50 to 70 wt% and said predetermined amount of magnesium oxide is in a range of from 50 to 30 wt%.

12. In a gas discharge display panel having discharge points defined by opposing sets of electrodes on opposing substrates across a gas filled volume, and each of said electrodes coated with a dielectric layer, the improvement comprising:

an overcoat layer contacting said gas filled volume and formed over said dielectric layer between each of said electrodes and said gas filled volume at least at said defined discharge points, said overcoat layer comprising a mixture of at least two alkaline earth metal compounds.

13. A gas discharge panel in accordance with claim 12, wherein said gas discharge display panel has a firing voltage characteristic of no more than 80 volts and a sustained voltage characteristic of no more than 70 volts.

14. A gas discharge panel in accordance with claim 12, wherein said overcoat layer comprises a mixture of a strontium compound and a calcium compound.

15. A gas discharge panel in accordance with claim 14, wherein said strontium compound is strontium oxide and said calcium compound is calcium oxide.

16. A gas discharge panel in accordance with claim 12, wherein said overcoat layer is formed by evaporating a source material mixture comprising a strontium compound in the range of from 50 to 90 weight percent and a calcium compound in the range of from 50 to 10 weight percent.

17. A gas discharge panel in accordance with claim 16, wherein said strontium compound is strontium oxide and said calcium compound is calcium oxide.

18. A gas discharge panel in accordance with claim 12, further comprising an insulating layer formed between said dielectric layer and said overcoat layer.

19. A gas discharge panel in accordance with claim 18, wherein said insulating layer is a material selected from the group comprising of $SiO_2$ and $Al_2O_3$.

20. In a method of manufacturing a gas discharge display panel, wherein opposing sets of electrodes are arranged on opposing substrates between a gas filled volume and are coated with a dielectric layer, the improvement comprising:

preparing a source material mixture of at least two alkaline earth metal compounds in predetermined amounts, evaporating said source material mixture onto said dielectric layer to form an outer overcoat layer for contact with said gas filled volume and comprising a mixture of at least two oxides of alkaline earth metals comprising said at least two alkaline earth metal compounds.

21. A method in accordance with claim 20, wherein said source material mixture comprises a strontium compound and a calcium compound.

22. A method in accordance with claim 21, wherein said strontium compound is strontium carbonate and said calcium compound is calcium carbonate.

23. In a gas discharge display panel having discharge points defined by opposing sets of electrodes on opposing substrates across a gas filled volume, with each of said electrodes coated with a respective dielectric layer, the improvement comprising:

an overcoat layer between each of said electrodes and said gas at least at said defining discharge points, said overcoat layer being a material comprising a mixture of at least two alkaline earth metal compounds, wherein said improved panel has a firing voltage characteristic of no more than 80 volts and a sustained voltage characteristic of no more than 70 volts.

24. In a gas discharge display panel having discharge points define by opposing sets of electrodes on opposing substrates across a gas filled volume, with each of said electrodes coated with a respective dielectric layer, the improvement comprising:

an overcoat layer between each of said electrodes and said gas at least at said defining discharge points, said overcoat layer being a material comprising a mixture of a strontium compound and at least one other alkaline earth metal compound, said strontium compound comprising more than 50% by weight of the overcoat layer material.

25. In a gas discharge display panel having discharge points defined by opposing sets of electrodes on opposing substrates across a gas filled volume, with each of said electrodes coated with a respective dielectric layer, the improvement comprising:

an overcoat layer between each of said electrodes and said gas at least at said defining discharge points, said overcoat layer being a meterial comprising a mixture of at least two alkaline earth metal compounds, wherein said overcoat layer is formed by evaporating a source material mixture of a strontium compound in a range from 50 to 90 weight percent and a calcium compound in a range from 50 to 10 weight percent.

26. A gas discharge panel in accordance with claim 24, wherein said other alkaline earth metal compound comprises a calcium compound.

27. A method in accordance with claim 20, wherein the source material mixture comprises strontium carbonate in the range of from 50 to 90 weight percent and calcium carbonate in the range from 50 to 10 weight percent.

* * * * *

UNITED STATES PATENT AND TRADEMARK OFFICE

CERTIFICATE OF CORRECTION

PATENT NO. : 4,198,585

DATED : April 15, 1980

INVENTOR(S) : Hideo Yamashita et al.

It is certified that error appears in the above—identified patent and that said Letters Patent is hereby corrected as shown below:

Col. 7, line 64, "descharge" should be --discharge--.

Signed and Sealed this

*Fifteenth* Day of *July 1980*

[SEAL]

*Attest:*

SIDNEY A. DIAMOND

*Attesting Officer*

*Commissioner of Patents and Trademarks*